US007258841B1

(12) United States Patent
Schmitt

(10) Patent No.: US 7,258,841 B1
(45) Date of Patent: Aug. 21, 2007

(54) REACTOR FOR GASIFYING GRANULAR FUELS THAT FORM A FIXED BED

(75) Inventor: Gerhard Schmitt, Schmitten (DE)

(73) Assignee: Metallgesellschaft Aktiengesellschaft, Frankfurt/Main (DE)

( * ) Notice: Subject to any disclaimer, the term of this patent is extended or adjusted under 35 U.S.C. 154(b) by 0 days.

(21) Appl. No.: 09/601,377

(22) PCT Filed: Sep. 7, 1999

(86) PCT No.: PCT/EP99/06584

§ 371 (c)(1),
(2), (4) Date: Jul. 27, 2000

(87) PCT Pub. No.: WO00/15738

PCT Pub. Date: Mar. 23, 2000

(30) Foreign Application Priority Data

Sep. 11, 1998 (DE) ..... 198 41 586

(51) Int. Cl.
*B01J 8/18* (2006.01)
*B32B 5/02* (2006.01)

(52) U.S. Cl. ..... 422/139; 422/145; 422/147

(58) Field of Classification Search ..... 422/139–147, 422/166–172; 110/223, 245, 216, 348
See application file for complete search history.

(56) References Cited

U.S. PATENT DOCUMENTS 2,958,298 A * 11/1960 Mayers ..... 110/344
4,021,184 A * 5/1977 Priestley
4,146,369 A * 3/1979 Flesch et al. ..... 48/201
4,441,892 A * 4/1984 Schuster ..... 48/197 R

* cited by examiner

*Primary Examiner*—Glenn Caldarola
*Assistant Examiner*—Tom P. Duong

(74) *Attorney, Agent, or Firm*—Jonathan Myers; Andrew Wilford

(57) ABSTRACT

The inventive reactor contains a fixed bed into whose lower area an oxygen-containing gasifying agent is introduced. Said gasifying agent moves upwards in the fixed bed. Product gas containing hydrogen and carbon monoxide is guided out of the reactor over the fixed bed, through a discharge channel. At least one cyclone is located in the reactor for separating solids from the product gas. Said cyclone has an inlet for the dust-laden product gas coming from the fixed bed, a discharge line for product gas and a solids removal line leading into the fixed bed. Said cyclone discharge line is connected to the discharge channel of the reactor.

4 Claims, 1 Drawing Sheet

REACTOR FOR GASIFYING GRANULAR FUELS THAT FORM A FIXED BED

DESCRIPTION

Figure 1:
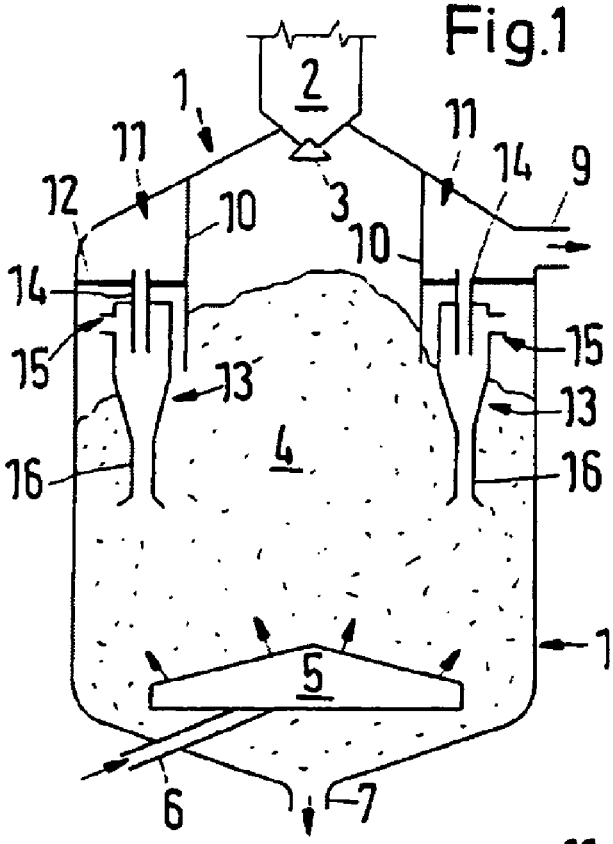

This invention relates to a reactor for gasifying granular fuels, where the fuel in the reactor forms a fixed bed in whose lower portion oxygen-containing gasifying medium is introduced, which moves upwards in the fixed bed, and where product gas containing hydrogen and carbon oxides is discharged from the reactor through a discharge duct above the fixed bed.

Reactors of this kind have long since been known and are described for instance in the U.S. Pat. No. 5,094,669, the EP patent 0,078,100 and the GB patent 2,003,589. The gasification is effected by means of a rotary grate in the reactor and the discharge of solid ash, or without rotary grate with discharge of liquid slag.

As fuel, all kinds of coal are used including lignite and peat, to which various waste substances may be added. When the fuel added to the fixed bed from the top is too fine-grained, a disturbingly large amount thereof is withdrawn from the reactor by the product gas and transported into the subsequent apparatuses. This may lead to operating failures which require the shut-down of the reactor. By increasing the maximum performance of a reactor and thus increasing the generation of product gas, it may also happen that the product gas stream withdraws too much fine-grained fuel from the reactor.

It is the object underlying the invention to design the above-mentioned reactor such that even with a strong product gas stream no disturbing amounts of fine-grained fuel are withdrawing from the reactor. In accordance with the invention this is achieved in that in the reactor at least one centrifugal separator is disposed for separating solids from the product gas, which centrifugal separator has an inlet opening for dust-laden product gas coming from the fixed bed, an outlet line for product gas, and a solids discharge line leading into the fixed bed, where the outlet line is connected with the discharge duct of the reactor.

Advantageously, several centrifugal separators are disposed in the reactor, where the outlet lines of the separators open into an annular chamber disposed in the upper portion of the reactor, which annular chamber communicates with the discharge duct.

An expedient embodiment of the invention consists in that in the upper portion of the reactor a vertical annular wall is provided, and that the inlet opening of the separator is disposed outside the portion of the reactor enclosed by the annular wall. The annular wall ensures that the inlet opening of the separator is disposed above the fixed bed.

Ideally, the cyclone is used as centrifugal separator, but other centrifugal separators may be used as well. The reactors usually operate at pressures of 1 to 80 bar.

Figure 2:
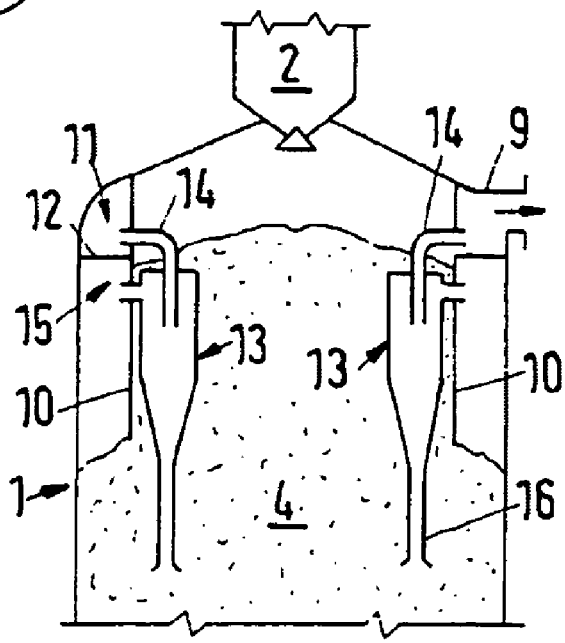
Figure 3:
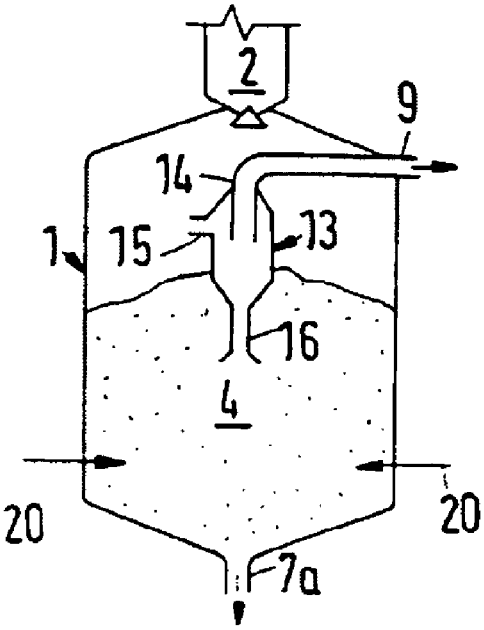

Embodiments of the reactor are illustrated with reference to the drawing, wherein:

FIG. 1 is a schematic representation of a gasification reactor with rotary grate in a longitudinal section, and FIG. 2 shows a second reactor variant in the representation analogous to FIG. 1, and FIG. 3 shows a further reactor variant.

The reactor shown in FIG. 1 has a casing 1, which usually is water-cooled. The granular fuel comes from the reservoir 2 and drops through the valve 3, which is open at this time, onto the fixed bed 4. In the lower portion of the reactor a rotary grate 5 is provided, to which a mixture of oxygen and stream is supplied through a gasifying medium line 6, which mixture is distributed from the rotary grate 5 into the fixed bed 4. In a manner not represented in detail, ash is withdrawn downwards through the opening 7.

The energy required in the endothermal gasification reactions is provided by partial oxidation. The crude product gas leaves the reactor through the discharge duct 9 and is supplied to a cooling and cleaning. At its upper end, a vertical annular wall 10 is connected with the reactor casing 1 in a gastight manner and serves as boundary for an annular chamber 11 which communicates with the discharge duct 9. A horizontal partition 12 in the form of an annular disk is disposed between the casing 1 and the annular wall 10 as lower boundary of the annular chamber 11.

In FIG. 1, two cyclones 13 are represented, whose outlet lines 14 extend upwards into the annular chamber 11. The inlet opening 15 of each cyclone 13 is disposed below the partition 12 and above the fixed bed 4. Dust-laden product gas, which flows out of the fixed bed 4, is forced through the openings 15 into one of the two cyclones 13, where the separated solids are recirculated through the respective solids discharge line 16 into the fixed bed 4. For a better downward discharge of the solids, the lower portion of the discharge line 16 is expended. The number of cyclones may be chosen as desired, and will usually be 1 to 10.

The product gas leaving the cyclones 13 flows through the outlet lines 14 first into the annular chamber 11 and then to the discharge duct 9. The dust content of this product gas is limited in this way, so that operating failures are avoided.

In accordance with FIG. 2, the cyclones 13 are disposed inside the portion enclosed by the annular wall 10 and thus more or less in the fixed bed 4, where the temperatures are relatively low. In the arrangement shown in FIG. 1, the cyclones 13 are disposed outside the annular wall 10, and product gas flows around them. The reference numerals of FIG. 2 have the meaning already explained in conjunction with FIG. 1.

The schematically illustrated reactor shown in FIG. 3 only has a cyclone 13, whose outlet line 14 is directly connected with the discharge duct 9. Dust-laden product gas, which comes from the fixed bed 4, flows into the cyclone through the opening 15, and separated solids are recirculated to the fixed bed 4 through the discharge line 16. The nozzles 20 are used for supplying the gasification medium, and liquid slag is withdrawn through the outlet 7*a*.

A gasification reactor with rotary grate 5, as it is represented in FIG. 1 or 2, can easily be equipped with only one cyclone 13 in accordance with FIG. 3, and the reactor shown in FIG. 3, which operates with the discharge of liquid slag, can likewise have several separating cyclones 13, as was explained in conjunction with FIG. 1 or FIG. 2.

The invention claimed is:

1. A reactor for gasifying granular fuels, the reactor comprising:

a casing provided in an upper portion with a vertical annular wall and a partition defining with the wall a generally closed annular chamber;

means including a reservoir holding the granular fuel and opening into the casing within the annular wall for forming in the casing below the partition a fixed bed of the granular fuel having an upper surface spaced below the partition;

means for introducing an oxygen-containing gasification medium into the bed below the surface thereof such that the gasification medium moves up through the fixed bed of granular fuel and creates an endothermic reaction in the fixed bed with partial oxidation of the bed and the creation of a product gas containing hydrogen and carbon oxides rising from the surface of bed, whereby the product gas entrains particles upward from the surface out of the fixed bed into a generally empty region below the partition, above the upper surface, and outside the annular wall;

at least one centrifugal separator in the casing and at least partially imbedded in the bed for separating particles from the product gas, the separator having an upper inlet opening in the empty region above the fixed bed of granular fuel for taking in the particle-laden product gas coming from the fixed bed of granular fuel, an outlet for product gas projecting through the partition and opening into the annular chamber, and a lower solid discharge opening directly into the fixed bed below the surface thereof; and means including a discharge duct connected to the annular chamber above the surface and via the chamber to the outlet of the separator for withdrawing the product gas from the casing.

2. The reactor for gasifying granular fuels defined in claim 1 wherein there are a plurality of the centrifugal separators in the casing and the discharge duct extends horizontally from the annular chamber.

3. The reactor for gasifying granular fuels defined in claim 1 wherein the centrifugal separator is disposed outside the portion enclosed by the annular wall.

4. The reactor for gasifying granular fuels defined in claim 1 wherein the centrifugal separator is a cyclone.

* * * * *